US009618177B2

(12) United States Patent
Ito et al.

(10) Patent No.: US 9,618,177 B2
(45) Date of Patent: Apr. 11, 2017

(54) VENTILATION STRUCTURE OF LIGHT FIXTURE FOR VEHICLE

(71) Applicant: Toyota Jidosha Kabushiki Kaisha, Toyota-shi, Aichi-ken (JP)

(72) Inventors: Akira Ito, Nagakute (JP); Makoto Mimoto, Aichi-ken (JP); Kazuma Otoguro, Toyota (JP); Tetsuya Sakimoto, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 36 days.

(21) Appl. No.: 14/884,127

(22) Filed: Oct. 15, 2015

(65) Prior Publication Data

US 2016/0109087 A1 Apr. 21, 2016

(30) Foreign Application Priority Data

Oct. 21, 2014 (JP) ..... 2014-214531
Dec. 2, 2014 (JP) ..... 2014-243924

(51) Int. Cl.
*F21S 8/10* (2006.01)

(52) U.S. Cl.
CPC ..... *F21S 48/335* (2013.01)

(58) Field of Classification Search
CPC ..... F21S 48/335
See application file for complete search history.

(56) References Cited

U.S. PATENT DOCUMENTS 4,724,515 A * 2/1988 Matsuki ..... F21S 48/337 362/268
2008/0165548 A1* 7/2008 Misawa ..... B60Q 1/2607 362/487
2016/0084471 A1* 3/2016 Sander ..... F21S 48/10 362/547

FOREIGN PATENT DOCUMENTS

JP 2002-124123 A 4/2002
JP 2011-253695 A 12/2011
JP 2012-134074 A 7/2012

* cited by examiner

*Primary Examiner* — David V Bruce
(74) *Attorney, Agent, or Firm* — Dinsmore & Shohl LLP

(57) ABSTRACT

A ventilation structure of a light fixture for a vehicle comprising a light fixture for a vehicle at which a suction port and an exhaust port are provided; a tube member having an upstream side opening portion into which traveling wind, that is taken-in when a vehicle travels, is introduced, and a downstream side opening portion from which the traveling wind is discharged; and a communication tube, one end portion thereof is connected to the exhaust port of the light fixture for a vehicle, and other end portion thereof is connected between the upstream side opening portion and the downstream side opening portion of the tube member, the other end portion extends into an interior of the tube member and opens toward a downstream side in a direction of passage of the traveling wind.

8 Claims, 8 Drawing Sheets

VENTILATION STRUCTURE OF LIGHT FIXTURE FOR VEHICLE

CROSS-REFERENCE TO RELATED APPLICATION

This application claims priorities under 35 USC 119 from Japanese Patent Applications No. 2014-214531 filed Oct. 21, 2014 and No. 2014-243924 filed Dec. 2, 2014, the disclosures of which are incorporated by reference herein.

BACKGROUND OF THE INVENTION

Technical Field

The present invention relates to a ventilation structure of a light fixture for a vehicle.

Related Art

A light fixture for a vehicle is known that, within a lamp chamber that is partitioned-off and formed by a housing and a lens that covers the opening portion of the housing, houses a bulb that is a light source, a reflector that reflects light from the bulb, and an extension that covers the gap between the reflector and the housing. Further, suppression of fogging of the inner surface of the lens has conventionally been carried out by forming a breathing hole in the back surface of the housing at this light fixture for a vehicle, and communicating the lamp chamber and the exterior via this breathing hole, and ventilating the interior of the lamp chamber by convection of air due to the temperature difference within the lamp chamber.

Japanese Patent Application Laid-Open (JP-A) No. 2002-124123 discloses a technique of forcibly cooling a lighting control circuit by forcibly causing outside air to flow into a space that is surrounded by a reflector and a lamp housing at a front light for a vehicle and in which the lighting control circuit is housed. In this prior technique, outside air is forcibly made to flow by connecting a venturi, that generates negative pressure due to traveling wind flowing therealong, via a connection tube to the space in which the lighting control circuit is housed.

However, in the above-described prior technique, the connection tube opens at the peripheral wall of the venturi. Accordingly, the negative pressure is small when the traveling wind is slow, and therefore, it is thought that the traveling wind that flows along the venturi will penetrate into the connection tube, and further, will penetrate into the front light for a vehicle from the connection tube. Accordingly, there is room for improvement with regard to this point.

SUMMARY

In view of the above-described circumstances, an object of the present invention is to improve the ventilation performance of a light fixture for a vehicle, while suppressing entrance of traveling wind into the light fixture for a vehicle.

A ventilation structure of a light fixture for a vehicle of a first aspect of the present invention has: a light fixture for a vehicle at which a suction port and an exhaust port are provided; a tube member having an upstream side opening portion into which traveling wind, that is taken-in when a vehicle travels, is introduced, and a downstream side opening portion from which the traveling wind is discharged; and a communication tube, one end portion thereof is connected to the exhaust port of the light fixture for a vehicle, and other end portion thereof is connected between the upstream side opening portion and the downstream side opening portion of the tube member, extends into an interior of the tube member, and opens toward a downstream side in a direction of passage of the traveling wind.

In the ventilation structure of a light fixture for a vehicle of the first aspect, traveling wind, that is taken-in at the time when the vehicle travels, is introduced-in from the upstream side opening portion of the tube member, and is discharged-out from the downstream side opening portion.

At the region, at which the other end portion of the communication tube is connected and opens, of the interior of the tube member, the region through which the wind passes (the wind passage surface area) is smaller by an amount corresponding to the surface area of the other end portion of the communication tube. Accordingly, due to the Venturi effect, at the periphery of the other end portion of the communication tube in the tube member, the flow velocity of the traveling wind increases, and the negative pressure becomes large. Accordingly, the suction force due to the negative pressure becomes large, and the ventilation performance of the light fixture for a vehicle improves.

Further, the other end portion of the communication tube extends into the interior of the tube member, and opens toward the downstream side, in the wind passage direction of the traveling wind, of the tube member. Accordingly, even in cases in which the traveling wind is slow and the negative pressure is small, traveling wind does not penetrate in from the opening portion of the other end portion of the communication tube. Accordingly, penetration of traveling wind into the light fixture for a vehicle is prevented. Further, because penetration of traveling wind into the light fixture for a vehicle is prevented, foreign matter and the like penetrating into the light fixture for a vehicle together with the traveling wind is prevented.

Accordingly, the ventilation performance of the interior of the light fixture for a vehicle improves, while penetrating of traveling wind into the light fixture for a vehicle is prevented.

In a ventilation structure of a light fixture for a vehicle of a second aspect of the present invention, in the structure of the first aspect, an intake port that takes-in the traveling wind is provided at a vehicle front end portion, and the upstream side opening portion of the tube member is connected to the intake port.

In the ventilation structure of a light fixture for a vehicle of the second aspect, by providing the intake port, that takes-in traveling wind, at the vehicle front end portion, the traveling wind is taken-in efficiently, and the traveling wind, that has been taken-in efficiently from the intake port, is introduced into the upstream side opening portion of the tube member. Accordingly, the amount of wind (the wind speed) of the traveling wind that passes through the tube member is ensured, and therefore, the suction force due to the negative pressure is large, and the ventilation performance of the light fixture for a vehicle improves more.

In a ventilation structure of a light fixture for a vehicle of a third aspect of the present invention, in the structure of the first aspect or the second aspect, a wind passage surface area of a region, at which the other end portion of the communication tube opens, of the tube member is set to be smaller than an opening sectional surface area of the upstream side opening portion.

In the ventilation structure of a light fixture for a vehicle of the third aspect, the wind passage surface area of the region, where the other end portion of the communication tube opens, of the tube member is smaller than the opening sectional surface area of the upstream side opening portion. Accordingly, due to the Venturi effect, the flow velocity of the traveling wind at the region, where the other end portion of the communication tube opens, of the tube member increases, and the negative pressure becomes large. Accordingly, the suction force due to the negative pressure becomes large, and the ventilation performance of the light fixture for a vehicle improves more.

In a ventilation structure of a light fixture for a vehicle of a fourth aspect of the present invention, in the structure of any of the first aspect through the third aspect, a filter for trapping foreign matter or a labyrinthine structural portion is provided at the exhaust port or the communication tube.

In the ventilation structure of a light fixture for a vehicle of the fourth aspect, even if foreign matter, such as water or dust or the like that has penetrated into the tube member due to the traveling wind, penetrates in from the communication tube, the foreign matter is trapped by the filter for trapping foreign matter or by the labyrinthine structural portion. Accordingly, foreign matter such as water or dust or the like penetrating into the light fixture for a vehicle via the communication tube and from the exhaust port is suppressed.

In a ventilation structure of a light fixture for a vehicle of a fifth aspect of the present invention, in the structure of any one of the first aspect through the fourth aspect, the downstream side opening portion is set so as to be positioned further toward a lower side than the upstream side opening portion.

In the ventilation structure of a light fixture for a vehicle of the fifth aspect, the downstream side opening portion of the tube member is positioned further toward the lower side than the upstream side opening portion. Accordingly, it is easy for foreign matter, such as water or dust or the like that has penetrated into the tube member, to be discharged-out from the downstream side opening portion. Accordingly, foreign matter such as water or dust or the like penetrating into the light fixture for a vehicle from the tube member via the communication tube and from the exhaust port is suppressed.

In a ventilation structure of a light fixture for a vehicle of a sixth aspect of the present invention, in the structure of any of the first aspect through the fifth aspect, the exhaust port is provided at one end portion in a vehicle transverse direction of the light fixture for a vehicle, and the suction port is provided at another end portion in the vehicle transverse direction of the light fixture for a vehicle.

In the ventilation structure of a light fixture for a vehicle of the sixth aspect, air is sucked-in from the suction port of the other end portion in the vehicle transverse direction of the light fixture for a vehicle, and is exhausted-out from the exhaust port of the one end portion in the vehicle transverse direction. Accordingly, ventilation is carried out over substantially the entire region in the vehicle transverse direction of the light fixture for a vehicle. Accordingly, the ventilation performance of the light fixture for a vehicle improves more.

In a ventilation structure of a light fixture for a vehicle of a seventh aspect of the present invention, in the structure of the sixth aspect, the exhaust port of the light fixture for a vehicle opens toward a vehicle transverse direction inner side.

In the ventilation structure of a light fixture for a vehicle of the seventh aspect, ventilation wind that flows-through the interior of the light fixture for a vehicle is exhausted from the exhaust port without bending greatly, and therefore, resistance to exhausting is low. Accordingly, the ventilation performance of the interior of the light fixture for a vehicle improves.

In a ventilation structure of a light fixture for a vehicle of an eighth aspect of the present invention, in the structure of any of the first aspect through the seventh aspect, the tube member is formed in a shape that is curved in an L-shape as seen in plan view, and the downstream side opening portion opens at a vehicle transverse direction inner side.

In the ventilation structure of a light fixture for a vehicle of the eighth aspect, the other end portion of the communication tube extends into the interior of the tube member that is L-shaped and whose downstream side opening portion opens at the vehicle transverse direction inner side. Due thereto, traveling wind does not penetrate in from the opening portion of the other end portion of the communication tube, and penetration of traveling wind into the light fixture for a vehicle is prevented. Further, because penetration of traveling wind into the light fixture for a vehicle is prevented, foreign matter or the like is prevented from penetrating into the light fixture for a vehicle together with the traveling wind.

In accordance with the ventilation structure of a light fixture for a vehicle of the first aspect, the ventilation performance of the interior of the light fixture for a vehicle can be improved, while penetration of traveling wind into the light fixture for a vehicle is prevented.

In accordance with the ventilation structure of a light fixture for a vehicle of the second aspect, the ventilation performance of the interior of the light fixture for a vehicle can be improved more.

In accordance with the ventilation structure of a light fixture for a vehicle of the third aspect, the ventilation performance of the interior of the light fixture for a vehicle can be improved more.

In accordance with the ventilation structure of a light fixture for a vehicle of the fourth aspect, penetration of foreign matter into the light fixture for a vehicle can be suppressed.

In accordance with the ventilation structure of a light fixture for a vehicle of the fifth aspect, penetration of foreign matter into the light fixture for a vehicle can be suppressed.

In accordance with the ventilation structure of a light fixture for a vehicle of the sixth aspect, the ventilation performance of the light fixture for a vehicle can be improved more.

In accordance with the ventilation structures of a light fixture for a vehicle of the seventh aspect and the eighth aspect, the ventilation performance of the light fixture for a vehicle can be improved.

BRIEF DESCRIPTION OF THE DRAWINGS

Embodiments of the present invention will be described in detail based on the following figures, wherein.

DETAILED DESCRIPTION OF THE INVENTION

First Embodiment

A ventilation structure of a light fixture for a vehicle relating to a first embodiment of the present invention is described by using FIG. 1 through FIG. 4 and FIG. 7.

(Structure)

Figure 1:
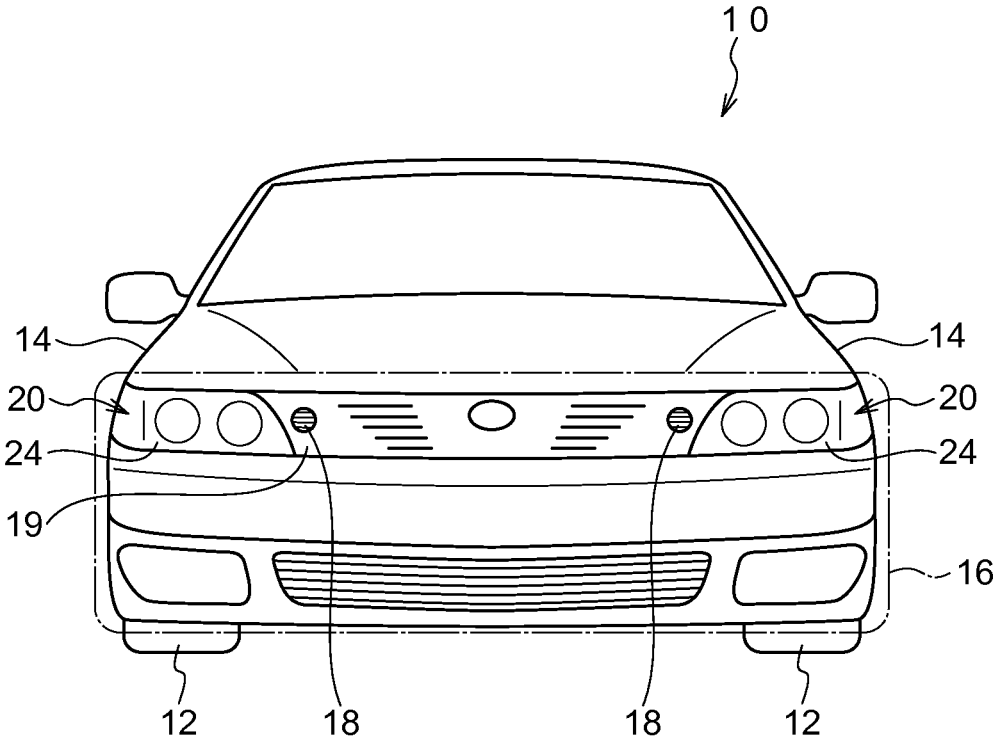
FIG. 1 is a front view of a vehicle to which a ventilation structure of a light fixture for a vehicle according to embodiments of the present invention is applied.

As shown in FIG. 1, a pair of left and right headlights 20, that are examples of light fixtures for a vehicle, are disposed at the vehicle transverse direction both end portions of a vehicle front end portion 16 of a vehicle 10. The shape of the headlight 20, as seen from the front, is a substantially parallelogram shape whose length direction is the vehicle transverse direction.

Figure 2:
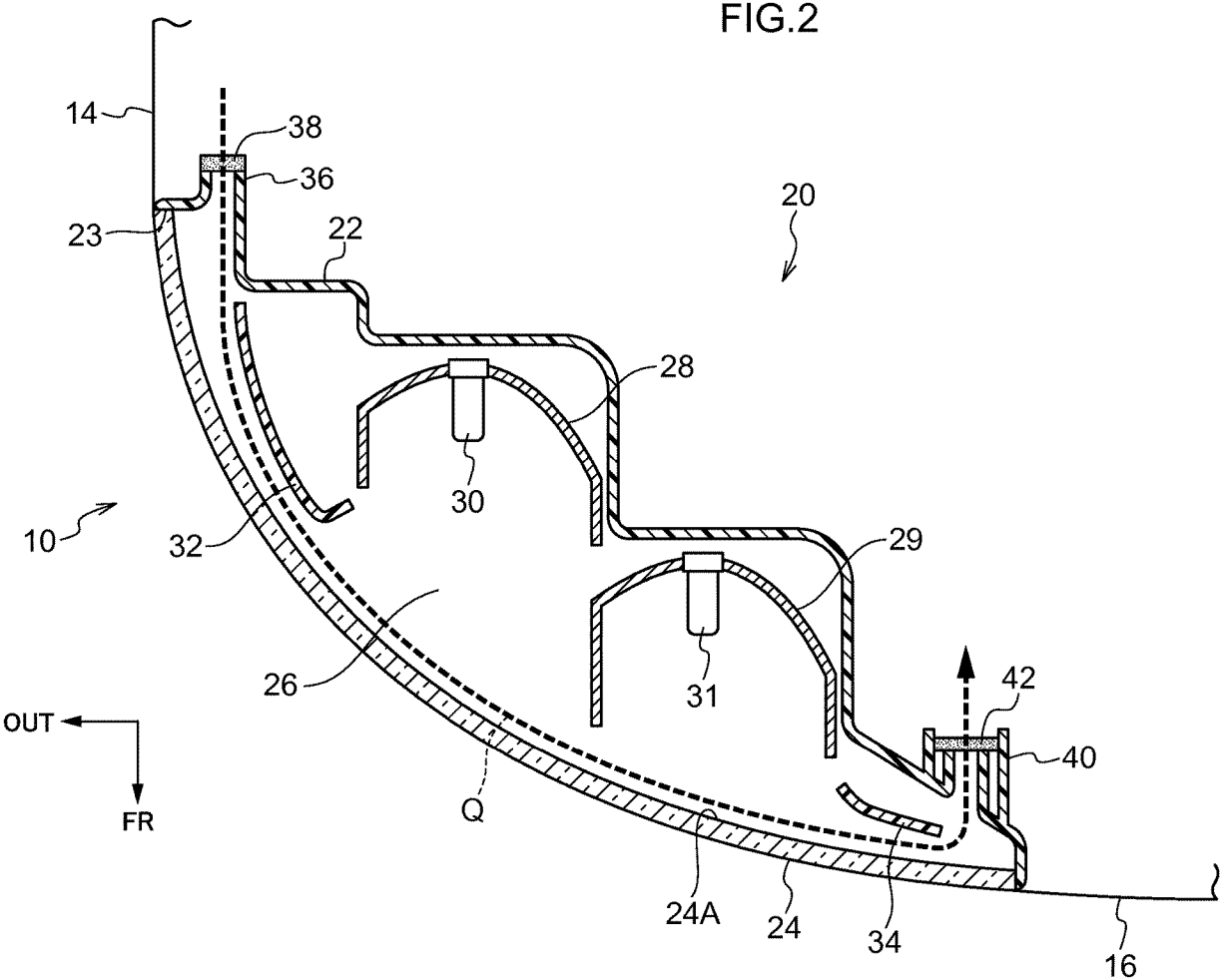
FIG. 2 is a horizontal sectional view of a headlight to which a ventilation structure of a light fixture for a vehicle of a first embodiment of the present invention is applied.

As shown in FIG. 1 and FIG. 2, the vehicle transverse direction outer side portion of the headlight 20 is curved toward the vehicle longitudinal direction rear side, and circles-in toward a fender 14 side that is above a front wheel 12 (see FIG. 1).

Note that, in the following description, the headlight 20 and a tube member 60 that is described later that are at the right side are illustrated and described. However, the headlight 20 and the tube member 60 at the left side as well have similar structures, other than having left-right symmetry with respect to the right-side headlight 20 and tube member 60.

As shown in FIG. 2, the headlight 20 has a housing 22 that is made of resin and in which is formed an opening portion 23 whose vehicle longitudinal direction front side is open. A lens 24 is assembled to the opening portion 23 of the housing 22 (refer to FIG. 1 as well). The joined portion of the outer peripheral edge portion of the lens 24 and the opening portion 23 of the housing 22 is sealed by an unillustrated sealing member. Note that, in the present embodiment, the space that is structured by the housing 22 and the lens 24 is made to be a lamp chamber 26.

A reflector 28 and a reflector 29, that are shaped as concave mirror surfaces (bowl-shaped) and that reflect light toward the vehicle longitudinal direction front side, are disposed in the lamp chamber 26 so as to be lined-up in the vehicle transverse direction. Further, a beam bulb 30 that serves as an example of a light source is disposed at a substantially central predetermined position of the reflector 28, and similarly, a beam bulb 31 is disposed at a substantially central predetermined position of the reflector 29.

Further, extensions 32, 34 that are made of resin are provided in the lamp chamber 26 between the housing 22 and the outer edge portions of the reflectors 28, 29.

A suction port 36, that opens toward the vehicle longitudinal direction rear side, is formed in the rear end portion of the vehicle transverse direction outer side of the housing 22 (the lamp chamber 26). An intake port side filter 38 for trapping foreign matter is provided at this suction port 36. Note that the intake port side filter 38 is removable (replaceable).

An exhaust port 40 that opens toward the vehicle longitudinal direction rear side is formed at the rear end portion of the vehicle transverse direction inner side of the housing 22 (the lamp chamber 26). A headlight side end portion 52 of a communication tube 50 that is described later (see FIG. 3) is connected to this exhaust port 40. An exhaust port side filter 42 for trapping foreign matter is provided at the connected region of the exhaust port 40 and the headlight side end portion 52 of the communication tube 50.

Figure 3:
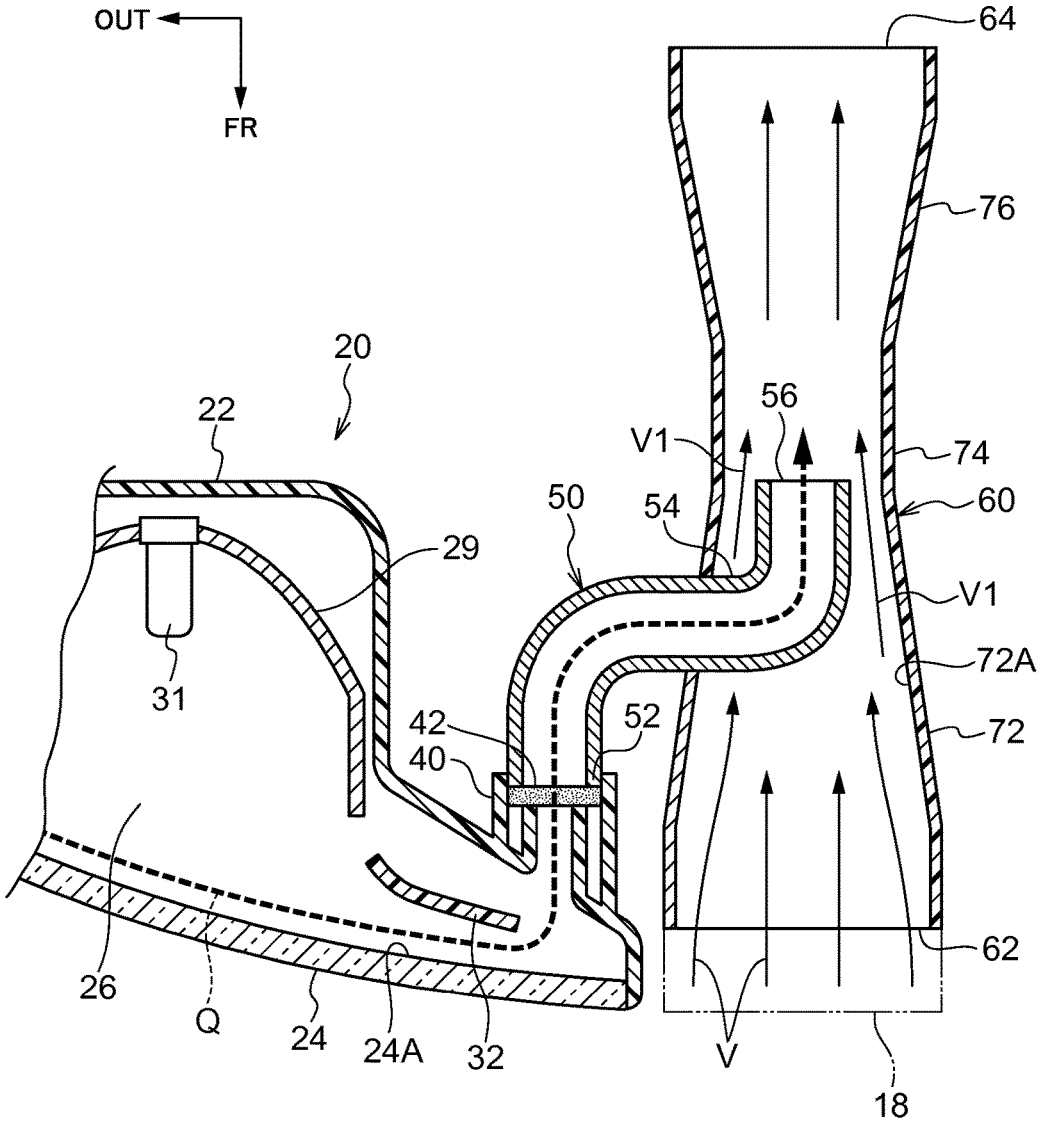
FIG. 3 is a horizontal sectional view of main portions of the ventilation structure of a light fixture for a vehicle of the first embodiment of the present invention.
Figure 4:
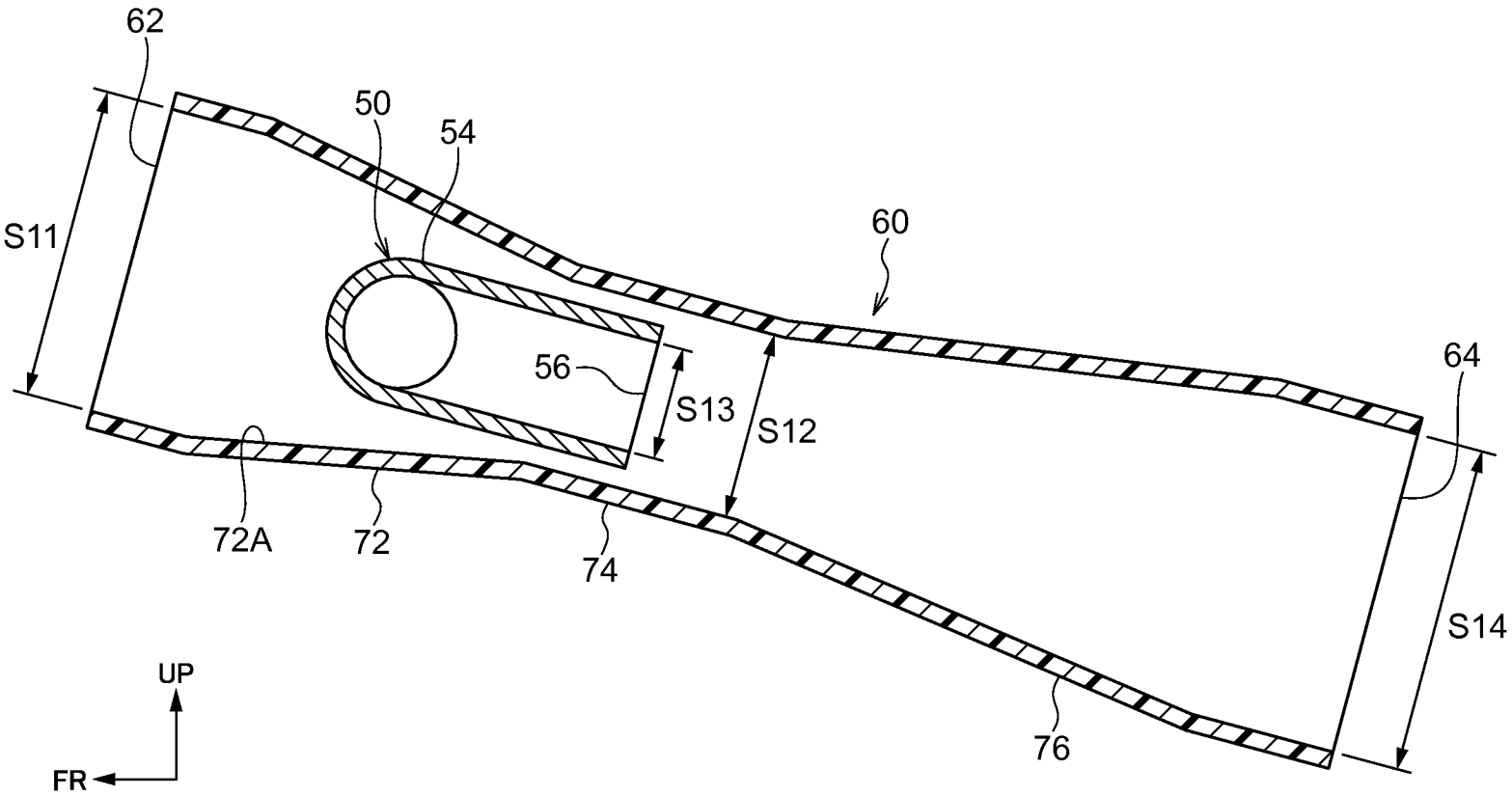
FIG. 4 is a vertical sectional view, along a vehicle longitudinal direction, of a tube member and a communication tube that structure the ventilation structure of a light fixture for a vehicle of the first embodiment of the present invention.

As shown in FIG. 3, the tube member 60 is disposed at the vehicle transverse direction inner side of the headlight 20. As shown in FIG. 3 and FIG. 4, the tube member 60 is disposed along the vehicle longitudinal direction, and an upstream side opening portion 62 opens at the vehicle longitudinal direction front side thereof, and a downstream side opening portion 64 opens at the vehicle longitudinal direction rear side thereof. Further, as shown in FIG. 4, the tube member 60 is disposed at an incline so as to head toward the lower side while heading toward the vehicle longitudinal direction rear side, and the downstream side opening portion 64 is positioned further toward the lower side than the upstream side opening portion 62 of the tube member 60.

As shown in FIG. 3, the upstream side opening portion 62 of the tube member 60 is connected to an intake port 18 that is provided at a front grill 19 of the vehicle front end portion 16 shown in FIG. 1, at the vehicle transverse direction inner side of the headlight 20. Further, the tube member 60 is structured such that, as shown in FIG. 3, at the time when the vehicle travels, traveling wind that is taken-in from the intake port 18 is introduced from the upstream side opening portion 62 into the tube member 60, and is discharged from the downstream side opening portion 64. Note that arrows V in FIG. 3 show the flow of the traveling wind.

As shown in FIG. 3 and FIG. 4, the front portion of the tube member 60 is made to be a reduced diameter portion 72 whose diameter decreases toward the downstream side of traveling wind V (the vehicle longitudinal direction rear side in the present embodiment). A negative pressure portion 74 (the reason for the negative pressure is explained later), whose tube diameter is uniform or substantially uniform, is formed at the traveling wind V downstream side (the vehicle longitudinal direction rear side in the present embodiment) of the reduced diameter portion 72. An enlarged diameter portion 76, whose diameter increases toward the downstream side, is formed at the traveling wind V downstream side (the vehicle longitudinal direction rear side in the present embodiment) of the negative pressure portion 74.

As shown in FIG. 3, a tube member side connecting portion 54 of the aforementioned communication tube 50 is connected to the reduced diameter portion 72 of the tube member 60. As shown in FIG. 3 and FIG. 4, the tube member side connecting portion 54 of the communication tube 50 extends into the interior of the tube member 60, and curves toward the downstream side (the vehicle longitudinal direction rear side), and a communication tube opening portion 56 opens toward the downstream side at the negative pressure portion 74.

As shown in FIG. 4, given that the opening sectional surface area of the upstream side opening portion 62 at the tube member 60 is S11, the wind passage surface area of the negative pressure portion 74 is S12, the opening sectional surface area of the downstream side opening portion 64 is S14, and the opening sectional surface area of the communication tube opening portion 56 of the communication tube 50 is S13, the respective surface areas are set such that:

S11>S12>S13

S12<S14.

(Operation and Effects)

Operation and effects of the present embodiment are described next.

As shown in FIG. 3, the traveling wind V, that is taken-in from the intake port 18 (see FIG. 1) of the vehicle front end portion 16 at the time when the vehicle travels, is introduced-in from the upstream side opening portion 62 of the tube member 60, and is discharged-out from the downstream side opening portion 64. Due to the difference in velocities between an air flow in the interior of the headlight 20 (the interior of the lamp chamber 26), and the traveling wind V that passes-through the interior of the tube member 60, negative pressure arises around the communication tube opening portion 56 of the communication tube 50, and air is sucked-in from the communication tube 50 due to this negative pressure.

Due to this suction, as shown in FIG. 2, air within the headlight 20 (within the lamp chamber 26) is exhausted from the exhaust port 40, and the interior of the headlight 20 is thereby ventilated. Note that, in the present embodiment, like ventilation wind that is shown by arrow Q, outside air is sucked-in from the suction port 36 that is at the rear end portion of the vehicle transverse direction outer side of the headlight 20 (the lamp chamber 26), and flows along an inner surface 24A of the lens 24, and is exhausted from the exhaust port 40 that is at the rear end portion of the vehicle transverse direction inner side. Accordingly, substantially the entire region (between the both end portions) in the vehicle transverse direction of the headlight 20 (the lamp chamber 26) is ventilated effectively.

Here, as shown in FIG. 3 and FIG. 4, the tube member side connecting portion 54 of the connection tube 50 extends into the interior of the tube member 60, and curves toward the downstream side, and, at the negative pressure portion 74, the communication tube opening portion 56 opens toward the downstream side. Accordingly, at the negative pressure portion 74 of the tube member 60, the region where the traveling wind V passes-through (the wind passage surface area) becomes narrower by an amount corresponding to the sectional surface area of the communication tube opening portion 56.

Moreover, the reduced diameter portion 72, whose diameter decreases from the upstream side opening portion 62 toward the negative pressure portion 74, is formed at the tube member 60, and the wind passage surface area S12 of the negative pressure portion 74 is more narrow than the opening sectional surface area S11 of the upstream side opening portion 62 (S11>S12).

Due to the wind passage region (surface area) of the negative pressure portion 74 at the tube member 60 narrowing in this way, the flow velocity of the traveling wind V increases due to the Venturi effect. Accordingly, the negative pressure around the communication tube opening portion 56 of the communication tube 50 becomes large.

Moreover, as shown by arrows V1, due to the reduced diameter portion 72, the traveling wind merges at the downstream side of the communication tube opening portion 56 of the tube member side connecting portion 54 of the communication tube 50. Accordingly, the negative pressure around the communication tube opening portion 56 of the communication tube 50 becomes large.

Further, the diameter of the downstream side of the tube member 60 is enlarged, and this downstream side is made to be the enlarged diameter portion 76. The opening sectional surface area S14 of the downstream side opening portion 64 is greater than the wind passage surface area S12 of the negative pressure portion 74 (S12<S14). Accordingly, resistance to exhausting of the traveling wind V decreases, and the traveling wind V is exhausted smoothly.

Because the negative pressure is great and the traveling wind V is exhausted smoothly in this way, the suction force becomes great and the ventilation performance of the headlight 20 improves. Further, even at times of traveling at low speed, the suction force (the ventilation performance) is ensured.

Further, by providing the intake port 18 (see FIG. 1), that takes-in the traveling wind V, at the vehicle front end portion 16, the traveling wind V is taken-in efficiently as compared with a case in which, for example, an intake port is provided at the vehicle side portion. Further, the traveling wind V, that is efficiently taken-in from the intake port 18 in this way, is introduced into the upstream side opening portion 62 of the tube member 60. Accordingly, the amount of wind (the wind speed) of the traveling wind V that passes-through the tube member 60 is ensured, and therefore, the suction force due to the negative pressure becomes large, and the ventilation performance of the headlight 20 (the lamp chamber 26) improves.

Further, as shown in FIG. 3 and FIG. 4, the tube member side connecting portion 54 of the communication tube 50 is connected to the tube member 60 and extends to within the tube member 60, and the communication tube opening portion 56 opens toward the downstream side. Accordingly, the traveling wind V is prevented from penetrating into the headlight 20 (the lamp chamber 26) from the communication tube opening portion 56 of the communication tube 50.

Accordingly, foreign matter, such as water or dust or the like that has penetrated into the tube member 60 due to the traveling wind V, is prevented from penetrating, together with the traveling wind V, into the headlight 20 (the lamp chamber 26) from the communication tube opening portion 56 of the communication tube 50.

Further, as shown in FIG. 4, at the tube member 60, the downstream side opening portion 64 is positioned further toward the lower side than the upstream side opening portion 62. Accordingly, it is easy for foreign matter, such as water or dust or the like that has penetrated into the tube member 60 due to the traveling wind V, to be discharged from the downstream side opening portion 64 even in a state in which the traveling wind V is not passing-through (at times when the vehicle is not traveling).

Further, as shown in FIG. 2 and FIG. 3, the exhaust port side filter 42 is provided at the connected region of the exhaust port 40 and the headlight side end portion 52 of the communication tube 50.

Accordingly, even if foreign matter such as water or dust or the like were to enter into the communication tube 50, because the foreign matter would be trapped by the above-described exhaust port side filter 42, the foreign matter such as water or dust or the like penetrating in via the communication tube 50 and from the exhaust port 40 of the headlight 20 into the lamp chamber 26 of the headlight 20 would be suppressed or prevented. Note that foreign matter that is trapped by the exhaust port side filter 42 is discharged into the tube member 60 by the ventilation wind Q at the time of traveling.

Further, as shown in FIG. 2, the suction port side filter 38 is provided at the suction port 36 that opens toward the vehicle longitudinal direction rear side of the rear end portion at the vehicle transverse direction outer side of the housing 22 (the lamp chamber 26) of the headlight 20. Accordingly, because foreign matter such as water or dust or the like is trapped by the suction port side filter 38, penetration of foreign matter into the headlight 20 (into the lamp chamber 26) is prevented or suppressed. Note that the suction port side filter 38 is removable (replaceable). Accordingly, even if foreign matter is trapped in the suction port side filter 38, the suction performance (ventilation performance) is restored by replacing the suction port side filter 38.

Here, at the headlight 20, the temperature within the headlight 20 (within the lamp chamber 26) rises due to heat from an unillustrated engine, radiant heat of sunlight, heat at the time when the beam bulbs 30, 31 are lit, and the like. Due to this rise in temperature, moisture is released into the headlight 20 interior (the lamp chamber 26 interior) from the resin parts (e.g., the housing 22) that structure the headlight 20, and the dew point temperature (the absolute humidity) of the interior of the headlight 20 (the interior of the lamp chamber 26) rises.

In the state in which the dew point temperature (the absolute humidity) of the interior of the headlight 20 (the interior of the lamp chamber 26) has risen in this way, condensation arises when the surface temperatures of the respective parts within the headlight 20 (within the lamp chamber 26) fall below the dew point temperature due to washing of the vehicle, rain, a drop in the outside air temperature, or the like. In particular, because it is easy for the temperature of the inner surface 24A of the lens 24 of the headlight 20 to decrease, it is easy for condensation to arise at the inner surface 24A of the lens 24.

However, at the headlight 20 of the present embodiment, as described above, air is sucked from the communication tube 50 due to the negative pressure that is formed at the tube member 60. Further, the ventilation wind Q, that is sucked from the suction port 36 at the rear end portion of the vehicle transverse direction outer side of the headlight 20 due to this suction, flows along the inner surface 24A of the lens 24, and is exhausted from the exhaust port 40 at the rear end portion of the vehicle transverse direction inner side (see FIG. 2). Due to the interior of the headlight 20 (the interior of the lamp chamber 26) being ventilated in this way, the moisture that is released from the resin parts into the headlight 20 interior (the lamp chamber 26 interior) is discharged, and the dew point temperature (the absolute humidity) decreases (the dew point temperature (the absolute humidity) becomes a level equivalent to the outside air).

Accordingly, the surface temperatures of the respective members within the headlight 20 (within the lamp chamber 26), and of the inner surface 24A of the lens 24 in particular, falling below the dew point temperature due to washing of the vehicle, rain, a drop in the outside air temperature, or the like is prevented or suppressed. As a result, the occurrence of condensation at the inner surface 24A of the lens 24 is prevented or suppressed.

Figure 7:
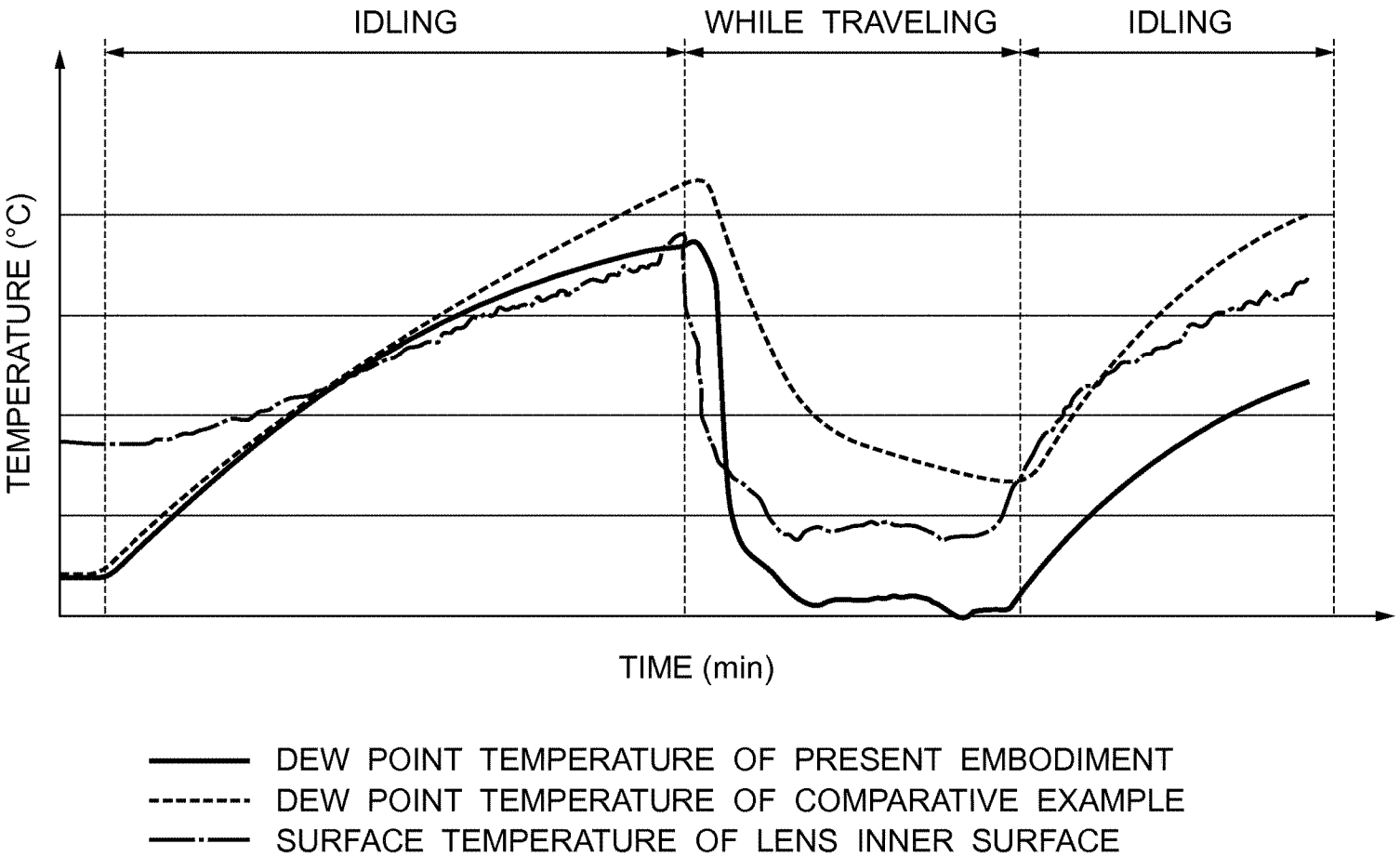
FIG. 7 is a graph showing the relationship between dew point temperature of a headlight interior (lamp chamber interior) and surface temperature of an inner surface of a lens, in a headlight to which a tube member is connected and in a headlight of a comparative example to which the tube member is not connected.

The graph of FIG. 7 shows the relationship between the surface temperature of the inner surface 24A of the lens 24 and the dew point temperature of the headlight interior (the lamp chamber 26 interior), at the headlight 20 to which the tube member 60 of the present embodiment is connected and at the headlight of a comparative example to which the tube member 60 is not connected. Note that the solid line is the dew point temperature of the headlight 20 of the present embodiment, the dashed line (dotted line) is the dew point temperature of the headlight of the comparative example, and the one-dot chain line is the surface temperature of the inner surface 24A of the lens 24.

Further, the initial state is a state in which the most moisture is contained in the resin parts that structure the headlight. Concretely, this is a state in which the vehicle has been parked (left) over a long time in summertime when the humidity is high.

When, from the initial state, the engine is started-up, the lights are turned on, and idling starts, the dew point temperature within the headlight (within the lamp chamber 26) rises and becomes higher than the surface temperature of the inner surface 24A of the lens 24, and condensation arises.

However, when the vehicle starts to travel (in the present example, at 50 km/h), the dew point temperature (the absolute humidity) and the surface temperature of the inner surface 24A of the lens 24 decrease in both the headlight 20 of the present embodiment and the headlight of the comparative example. Because the ventilation performance of the headlight 20 of the present embodiment is improved, the dew point temperature becomes lower than the surface temperature of the inner surface 24A of the lens 24, and the condensation is eliminated. On the other hand, because the ventilation performance of the headlight of the comparative example is insufficient, the dew point temperature remains higher than the surface temperature of the inner surface 24A of the lens 24, and the condensation is not eliminated.

Further, the case, in which the vehicle is stopped and is set in an idling state after this traveling, is after moisture has been released from the resin parts that structure the headlight, and therefore, there is little releasing of moisture from the resin parts. Further, because the headlight 20 of the present embodiment is ventilated during traveling and becomes an absolutely humidity of about the same level as that of the outside air, the state in which the dew point temperature is lower than the surface temperature of the inner surface 24A of the lens 24 is maintained, and the occurrence of condensation is prevented or suppressed. On the other hand, because the ventilation performance of the headlight of the comparative example is insufficient and the absolute humidity thereof is high, the dew point temperature becomes higher than the temperature of the inner surface 24A of the lens 24, and condensation occurs.

Second Embodiment

Figure 5:
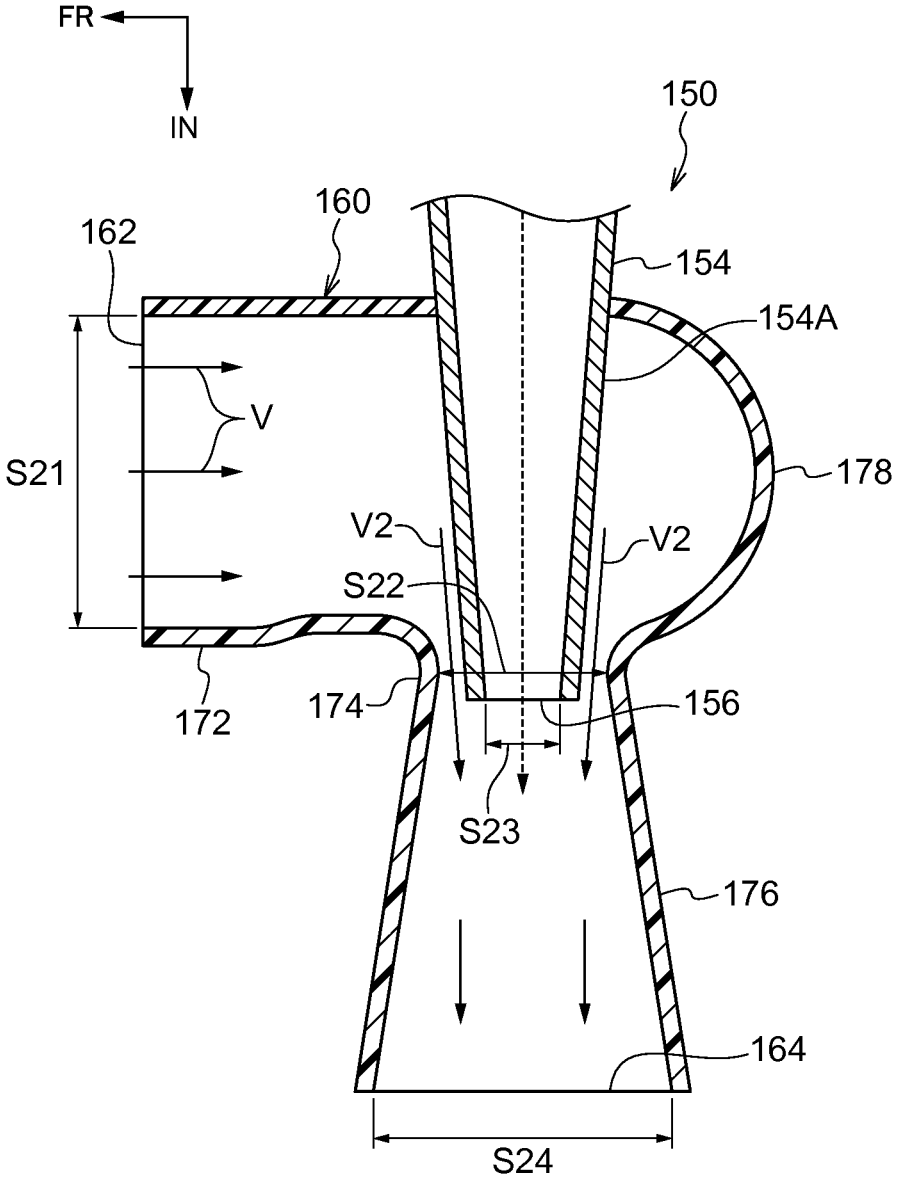
FIG. 5 is a horizontal sectional view of a tube member and a communication tube that structure a ventilation structure of a light fixture for a vehicle of a second embodiment of the present invention.

A ventilation structure of a light fixture for a vehicle relating to a second embodiment of the present invention is described by using FIG. 5. Note that members that are the same as those of the first embodiment are denoted by the same reference numerals, and repeat description thereof is omitted.

(Structure)

Because the structure of the headlight 20 is similar to that of the first embodiment, description thereof is omitted. Further, the structures of a communication tube 150 of the present embodiment are similar to those of the communication tube 50 of the first embodiment (see FIG. 3 and FIG. 4), other than a tube member side connecting portion 154.

As shown in FIG. 5, a tube member 160 of the second embodiment is formed in a shape that is curved in an L-shape as seen in plan view. An upstream side opening portion 162 of the tube member 160 opens at the vehicle longitudinal direction front side, and a downstream side opening portion 164 opens at the vehicle transverse direction inner side.

An upstream portion 172 of the tube member 160 extends toward the vehicle longitudinal direction rear side, and a curved portion 178 that is curved in an arc shape is formed at the downstream side end portion of the upstream portion 172. A downstream portion 176 of the tube member 160 extends from the vehicle transverse direction outer side toward the vehicle transverse direction inner side, at the downstream side of the upstream portion 172. Further, the diameter of the downstream portion 176 is enlarged toward the vehicle transverse direction inner side. Note that the end portion of the downstream portion 176 that is joined to the upstream portion 172 is made to be a negative pressure portion 174.

The tube member side connecting portion 154 of the communication tube 150 is connected to the wall surface at the vehicle transverse direction outer side of the upstream portion 172 of the tube member 160. The tube member side connecting portion 154 of the communication tube 150 extends into the interior of the tube member 160 toward the downstream side opening portion 164, and a communication tube opening portion 156 opens toward the downstream side at the negative pressure portion 174. Further, the diameter of the tube member side connecting portion 154 decreases toward the communication tube opening portion 156.

Note that, given that the opening sectional surface area of the upstream side opening portion 162 of the tube member 160 is S21, the wind passage surface area of the negative pressure portion 174 is S22, the opening sectional surface area of the downstream side opening portion 164 is S24, and the opening sectional surface area of the communication tube opening portion 156 of the communication tube 150 is S23, the respective surface areas are set such that

S21>S22>S23

S22<S24.

(Operation and Effects)

Operation and effects of the present embodiment are described next. Note that description of operation and effects that are similar to those of the first embodiment is omitted because it is redundant.

The tube member side connecting portion 154 of the communication tube 150 extends into the interior of the tube member 160 toward the downstream side opening portion 164, and the communication tube opening portion 156 opens at the negative pressure portion 174. Accordingly, at the negative pressure portion 174 of the tube member 160, the region (surface area) over which the traveling wind V passes becomes narrow by an amount corresponding to the surface area of the communication tube opening portion 156.

Moreover, at the tube member 160, the wind passage surface area S22 of the negative pressure portion 174 is narrower than the opening sectional surface area S21 of the upstream side opening portion 162 (S21>S22).

Due to the wind passage region (surface area) of the negative pressure portion 174 at the tube member 160 narrowing in this way, the flow velocity of the traveling wind V increases due to the Venturi effect. Accordingly, the negative pressure around the communication tube opening portion 156 of the communication tube 150 becomes large.

Further, as shown by arrows V2, the traveling wind merges at the downstream side of the communication tube opening portion 156 of the tube member side connecting portion 154, due to a wall surface 154A of the tube member side connecting portion 154 whose diameter narrows toward the downstream side. Accordingly, the negative pressure around the communication tube opening portion 156 of the communication tube 150 becomes large.

Further, the diameter of the downstream portion 176 of the tube member 160 is enlarged, and the opening sectional surface area S24 of the downstream side opening portion 164 is greater than the wind passage surface area S22 of the negative pressure portion 174 (S22<S24). Accordingly, resistance to exhausting of the traveling wind V decreases, and the traveling wind V is exhausted smoothly.

Because the negative pressure is great and the traveling wind V is exhausted smoothly in this way, the suction force becomes great and the ventilation performance of the headlight 20 improves. Further, even at times of traveling at low speed, the suction force (the ventilation performance) is ensured.

Further, the tube member side connecting portion 154 of the communication tube 150 is connected to the tube member 160 and extends to within the tube member 160, and the communication tube opening portion 156 opens toward the downstream side. Accordingly, the traveling wind V is prevented from penetrating in from the communication tube opening portion 156 of the communication tube 150.

Accordingly, foreign matter, such as water or dust or the like that has penetrated into the tube member 160 due to the traveling wind V, is prevented from penetrating, together with the traveling wind V, into the headlight 20 (the lamp chamber 26) from the communication tube opening portion 156 of the communication tube 150.

Third Embodiment

Figure 6:
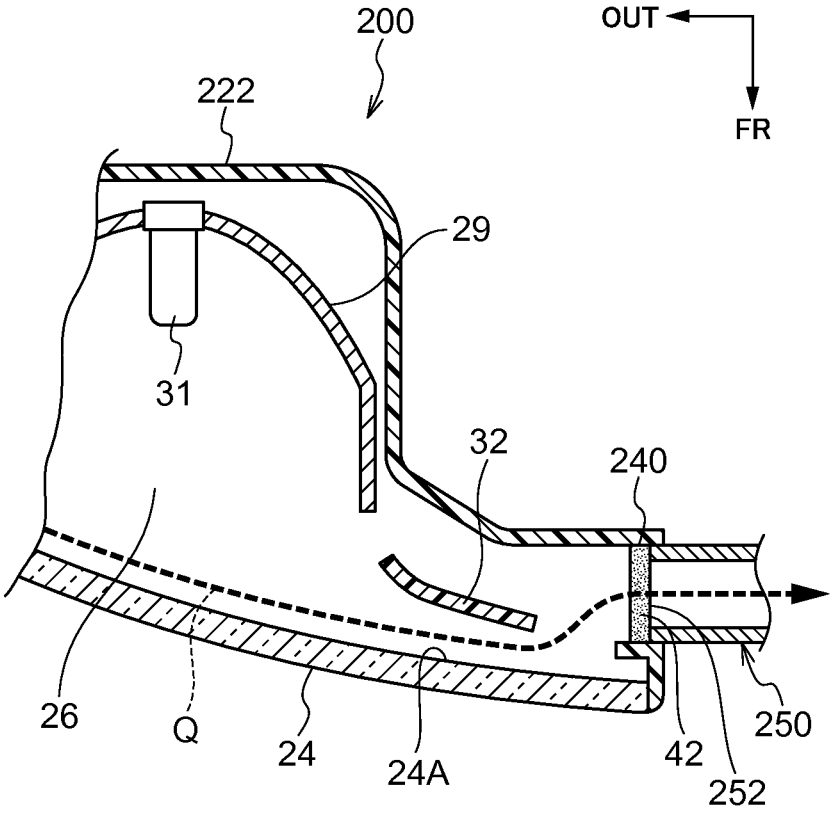
FIG. 6 is a horizontal sectional view of main portions of a headlight to which a ventilation structure of a light fixture for a vehicle of a third embodiment of the present invention is applied.

A ventilation structure of a light fixture for a vehicle relating to a third embodiment of the present invention is described by using FIG. 6. Note that members that are the same as those of the first embodiment and the second embodiment are denoted by the same reference numerals, and repeat description thereof is omitted.

(Structure)

As shown in FIG. 6, as compared with the headlight 20 of the first embodiment (see FIG. 2), a headlight 200 of the present embodiment has a structure that is substantially similar other than the structure of the placement of the exhaust port 40.

An exhaust port 240, that opens toward the vehicle transverse direction inner side, is formed at the side end portion at the vehicle transverse direction inner side of a housing 222 (the lamp chamber 26) of the headlight 200. An end portion 252 of a communication tube 250 is connected to the exhaust port 240 that is at this side end portion. Further, the exhaust port side filter 42 for trapping foreign matter is provided at the region of connection of the exhaust port 240 and the end portion 252 of the communication tube 250.

The tube member to which the communication tube 250 is connected is the tube member 60 of the first embodiment (see FIG. 3 and FIG. 4) or the tube member 160 of the second embodiment. Note that the tube member side connecting portion of the communication tube 250 is a structure that is similar to the tube member side connecting portion 54 or the tube member side connecting portion 154 that is connected to the tube member 60 or the tube member 160.

(Operation and Effects)

Operation and effects of the present embodiment are described next.

Due to the traveling wind V that is taken-in from the intake port 18 (see FIG. 1) of the vehicle front end portion 16 when the vehicle travels, negative pressure arises around the communication tube opening portion (the communication tube opening portion 56 or the communication tube opening portion 156) of the communication tube 250 at the tube member (the tube member 60 or the tube member 160), and air is sucked-in from the communication tube 250 due to this negative pressure (refer to FIG. 3 through FIG. 5).

Due to this suction, like the ventilation wind Q that is shown in FIG. 6, outside air is sucked-in from the suction port 36 (see FIG. 2) at the rear end portion of the vehicle transverse direction outer side of the headlight 200 (the lamp chamber 26), and flows along the inner surface 24A of the lens 24, and is exhausted from the exhaust port 240 that is at the side end portion at the vehicle transverse direction inner side.

At the side end portion at the vehicle transverse direction inner side of the housing 222 (the lamp chamber 26) of the headlight 200, the exhaust port 240 of the present embodiment opens toward the vehicle transverse direction inner side. Accordingly, the ventilation wind Q that has flowed along the inner surface 24A of the lens 24 is exhausted from the exhaust port 240 without bending greatly, and therefore, resistance to exhausting is low. Accordingly, the ventilation performance of the headlight 200 (the lamp chamber 26) improves.

<Other Points>

Note that the present invention is not limited to the above-described embodiments.

In the above-described embodiments, the wind passage surface area S12, S22 of the negative pressure portion of the tube member 60, 160 and the opening sectional surface area S14, S24 of the downstream side opening portion 64, 164 are set such that

S12<S14

S22<S24, but the present invention is not limited to this.

The respective surface areas may be set such that

S12=S14

S22=S24.

Further, the tube member 160 of the second embodiment that is shown in FIG. 5 is formed in a shape that is curved in an L-shape as seen in plan view, and the tube member 160 is disposed such that the upstream side opening portion 162 opens at the vehicle longitudinal direction front side, and the downstream side opening portion 164 opens at the vehicle transverse direction inner side.

However, the tube member 160 of the second embodiment may be disposed such that the downstream side opening portion 164 opens toward the vehicle vertical direction lower side. In this case, there is a structure in which, even if there is a state in which the traveling wind V is not passing-through (i.e., at times when the vehicle is not traveling), it is easy for foreign matter such as water or dust or the like that has penetrated into the tube member 160 to drop-down and be discharged-out from the downstream side opening portion 164. Moreover, because the communication tube opening portion 156 of the communication tube 150 as well is made to be a structure that opens toward the lower side, there is a structure in which it is difficult for foreign matter to penetrate into the communication tube 150. Further, this is a structure in which, even if foreign matter were to penetrate into the communication tube 150, the foreign matter would drop-down.

Further, as shown in FIG. 1, the intake port 18 of the traveling wind V is provided at the vehicle transverse direction inner side of the headlight 20 at the front grill 19 of the vehicle front portion 16. However, the present invention is not limited to this. The intake port 18 may be provided anywhere provided that it can take-in the traveling wind V. However, from the standpoint of the intake efficiency, it is desirable that the intake port 18 be provided at the vehicle front end portion 16 that is shown by the one-dot chain line in FIG. 1. Further, the upstream side opening portion of the tube member and the intake port may be connected by a connecting member such as a tube or the like.

Further, the exhaust port side filter 42 is provided at the region of connection between the exhaust port 40 and the communication tube 50, but the present invention is not limited to this. An exhaust port side filter may be provided at the communication tube 50, 150 between the exhaust port 40 and the communication tube opening portion 56, 156, or may be provided at the communication tube opening portion 56, 156.

Figure 8:
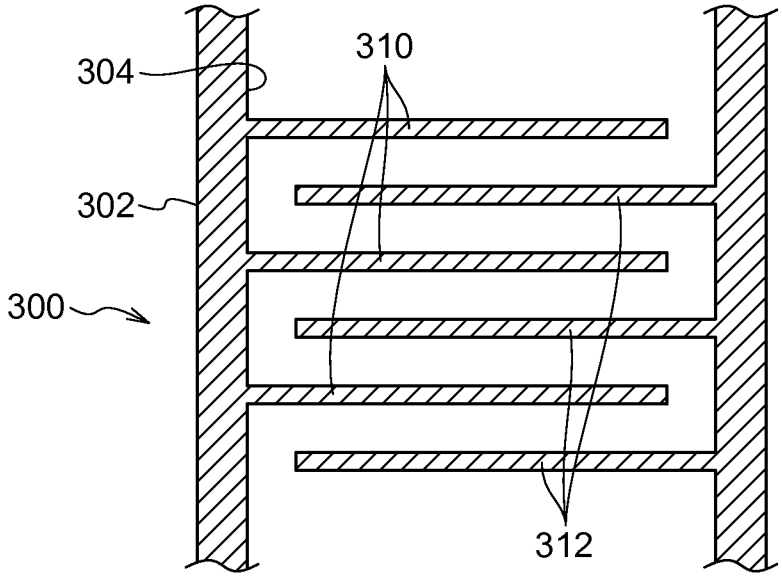
FIG. 8 is a cross-sectional view of a labyrinthine structural portion.

Further, a member or a mechanism for trapping foreign matter, other than the exhaust port side filter 42, may be provided at the communication tube. For example, a labyrinthine structural portion 300 shown in FIG. 8 may be provided. The labyrinthine structural portion 300 is a structure at which ribs 310 and ribs 312 are formed alternately so as to overlap in the axial direction at an inner wall 302A of a communication tube 302, and into which it is difficult for foreign matter to penetrate.

Moreover, it goes without saying that the present invention can be implemented in various forms within the scope thereof.

What is claimed is:

1. A ventilation structure of a light fixture for a vehicle, comprising:

a suction port and an exhaust port provided at the light fixture;

a tube member having an upstream side opening portion into which traveling wind, that is taken-in when a vehicle travels, is introduced, and a downstream side opening portion from which the traveling wind is discharged; and a communication tube, one end portion thereof is connected to the exhaust port of the light fixture for a vehicle, and other end portion thereof is connected between the upstream side opening portion and the downstream side opening portion of the tube member, the other end portion extends into an interior of the tube member and opens toward a downstream side in a direction of passage of the traveling wind.

2. The ventilation structure of a light fixture for a vehicle of claim 1, wherein:

an intake port that takes-in the traveling wind is provided at a vehicle front end portion, and the upstream side opening portion of the tube member is connected to the intake port.

3. The ventilation structure of a light fixture for a vehicle of claim 1, wherein a wind passage surface area of a region, at which the other end portion of the communication tube opens, of the tube member is set to be smaller than an opening sectional surface area of the upstream side opening portion.

4. The ventilation structure of a light fixture for a vehicle of claim 1, wherein a filter for trapping foreign matter or a labyrinthine structural portion is provided at the exhaust port or the communication tube.

5. The ventilation structure of a light fixture for a vehicle of claim 1, wherein the downstream side opening portion is set so as to be positioned further toward a lower side than the upstream side opening portion.

6. The ventilation structure of a light fixture for a vehicle of claim 1, wherein the exhaust port is provided at one end portion in a vehicle transverse direction of the light fixture for a vehicle, and the suction port is provided at another end portion in the vehicle transverse direction of the light fixture for a vehicle.

7. The ventilation structure of a light fixture for a vehicle of claim 1, wherein the exhaust port of the light fixture for a vehicle opens toward a vehicle transverse direction inner side.

8. The ventilation structure of a light fixture for a vehicle of claim 1, wherein the tube member is formed in a shape that is curved in an L-shape as seen in plan view, and the downstream side opening portion opens at a vehicle transverse direction inner side.

* * * * *